United States Patent [19]

Neff et al.

[11] 4,328,924

[45] May 11, 1982

[54] ARTICLE CONTAINER

[75] Inventors: Robert G. Neff; Garth H. Miller, both of Cincinnati; Denson C. Pate, Jr., New Richmond, all of Ohio; John L. Williams, Jr., Atlanta, Ga.

[73] Assignee: The Mead Corporation, Dayton, Ohio

[21] Appl. No.: 224,034

[22] Filed: Jan. 12, 1981

[51] Int. Cl.[3] ..... B65D 5/68

[52] U.S. Cl. ..... 229/43; 206/606; 206/616

[58] Field of Search ..... 229/43, 5.5; 206/604, 206/605, 606, 616

[56] References Cited

U.S. PATENT DOCUMENTS

| | | | |
|---|---|---|---|
| 2,002,564 | 5/1935 | Bergman | 206/604 |
| 2,053,529 | 9/1936 | Nelson | 206/616 |
| 2,323,335 | 7/1943 | Kaye | 206/616 |
| 2,517,801 | 8/1950 | Roush | 206/616 |
| 2,817,431 | 12/1957 | Cecil | 229/43 |
| 3,204,849 | 9/1965 | Vinney | 206/606 |
| 3,285,496 | 11/1966 | Barnhardt, Sr. et al. | 229/43 |
| 3,568,917 | 3/1971 | Vergobbi | 229/43 |
| 3,967,774 | 7/1976 | Querner | 229/43 |
| 3,976,241 | 8/1976 | Bemiss | 229/43 |
| 4,022,373 | 5/1977 | Kohnlein et al. | 206/606 |

*Primary Examiner*—Stephen P. Garbe

*Attorney, Agent, or Firm*—Rodgers & Rodgers

[57] ABSTRACT

An article container comprising a sleeve formed of side and end walls, a pair of closure caps disposed respectively in coincidence with the openings of the sleeve, the closure caps having attachment flaps joined respectively to the edges thereof and adhered in overlapping relationship with the associated wall, a tear strip disposed intermediate the attachment flaps of each closure cap and the walls, an access aperture formed in at least one attachment flap so as to expose an end of the associated tear strip, and a crease line formed in the attachment flaps and disposed in coincidence with the associated tear strip.

10 Claims, 5 Drawing Figures

ARTICLE CONTAINER

TECHNICAL FIELD

This invention relates to article shipping containers formed partially from corrugated fiberboard in combination with less expensive paperboard closure caps and having a convenient opening feature.

BACKGROUND ART

Composite article containers formed from conventional corrugated fiberboard in combination with paperboard or shrink wrap closure means are known in the art. Such containers are used to package paperboard boxes of dry cereal, laundry powders and the like. One example is found in U.S. Pat. 3,918,584. In the past these known containers have required the use of costly machinery to perform the loading and sealing functions and have generally been found to be less than desirable from the standpoint of strength and structural rigidity. Also the shrink wrap containers are ecologically unsatisfactory.

DISCLOSURE OF THE INVENTION

By this invention an article container is provided and comprises side and end walls joined together to form a sleeve, a closure cap disposed in coincidence with at least one opening of the sleeve and having an attachment flap joined to an edge thereof, the attachment flap being secured in overlapping relationship with the outer surface of the associated wall, and a tear strip disposed intermediate the wall and the attachment flap.

BEST MODE FOR CARRYING OUT THE INVENTION

Figure 3:
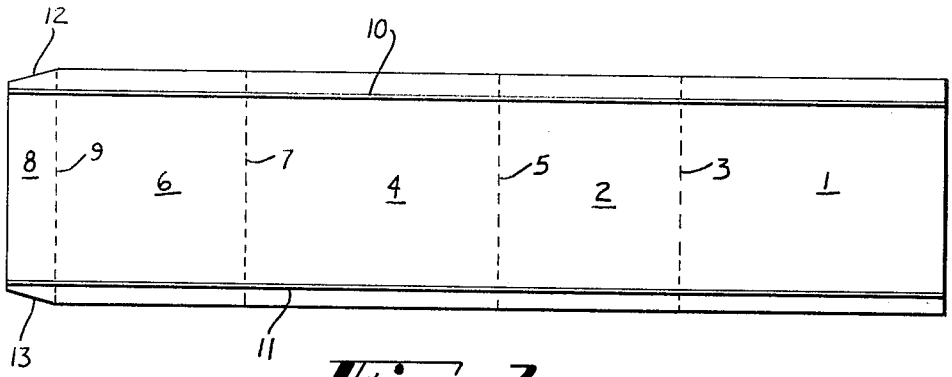
FIG. 3 is a plan view of the blank from which the article container sleeve is formed.

In the drawings and with particular reference to FIG. 3, the numeral 1 designates a side wall of the article container sleeve. End wall 2 is joined to side wall 1 along fold line 3 and, in similar fashion, side wall 4 is joined to end wall 2 along fold line 5. Also end wall 6 is joined to side wall 4 along fold line 7 and glue lap 8 is joined to end wall 6 along fold line 9.

According to a feature of this invention, tear strips 10 and 11 are adhered to the article container sleeve and extend the entire longitudinal length of the sleeve. Also tear strips 10 and 11 are provided with ends 12 and 13 respectively, the ends of which are in close coincidence with the free end edge of glue lap 8. Although any suitable tape can be utilized to form tear strips 10 and 11, it has been found that a plastic tape manufactured by H. B. Fuller Co. and sold under the trademark King String is well suited for use in this article container. The King String tape is adhered to the article container sleeve by known hot melt methods. If desired tear strips 10 and 11 could be of the pressure sensitive type.

Figure 4:
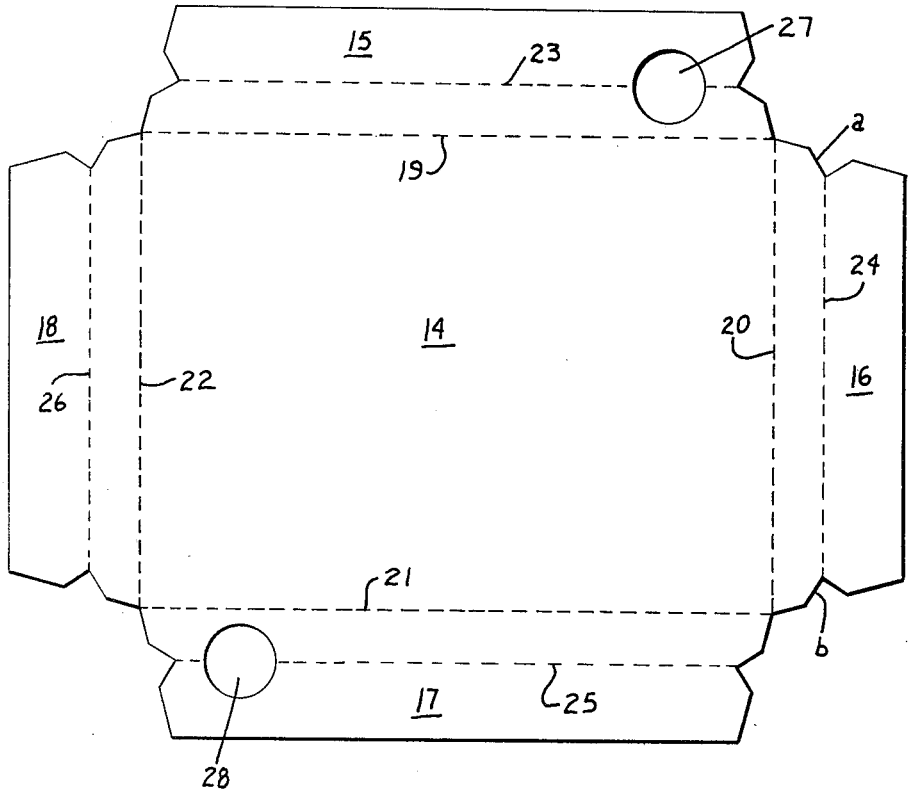
FIG. 4 is a plan view of the blank from which a closure cap and related elements are formed.

The closure cap for the article container is shown in blank form in FIG. 4 and is identified by the numeral 14. Attachment flaps 15, 16, 17, and 18 are foldably joined to the edges of closure cap 14 along fold lines 19, 20, 21, and 22 respectively. In addition crease lines 23, 24, 25, and 26 are formed in attachment flaps 15, 16, 17, and 18 respectively. Disposed along the respective end edges of each attachment flap 15–18 are alignment notches a and b. Each alignment notch a and b is V-shaped with the apex thereof disposed at the end of the associated crease line 23–26. Finally access apertures 27 and 28 are formed in attachment flaps 15 and 17 respectively and are positioned respectively in proximity to the associated ends thereof.

Figure 5:
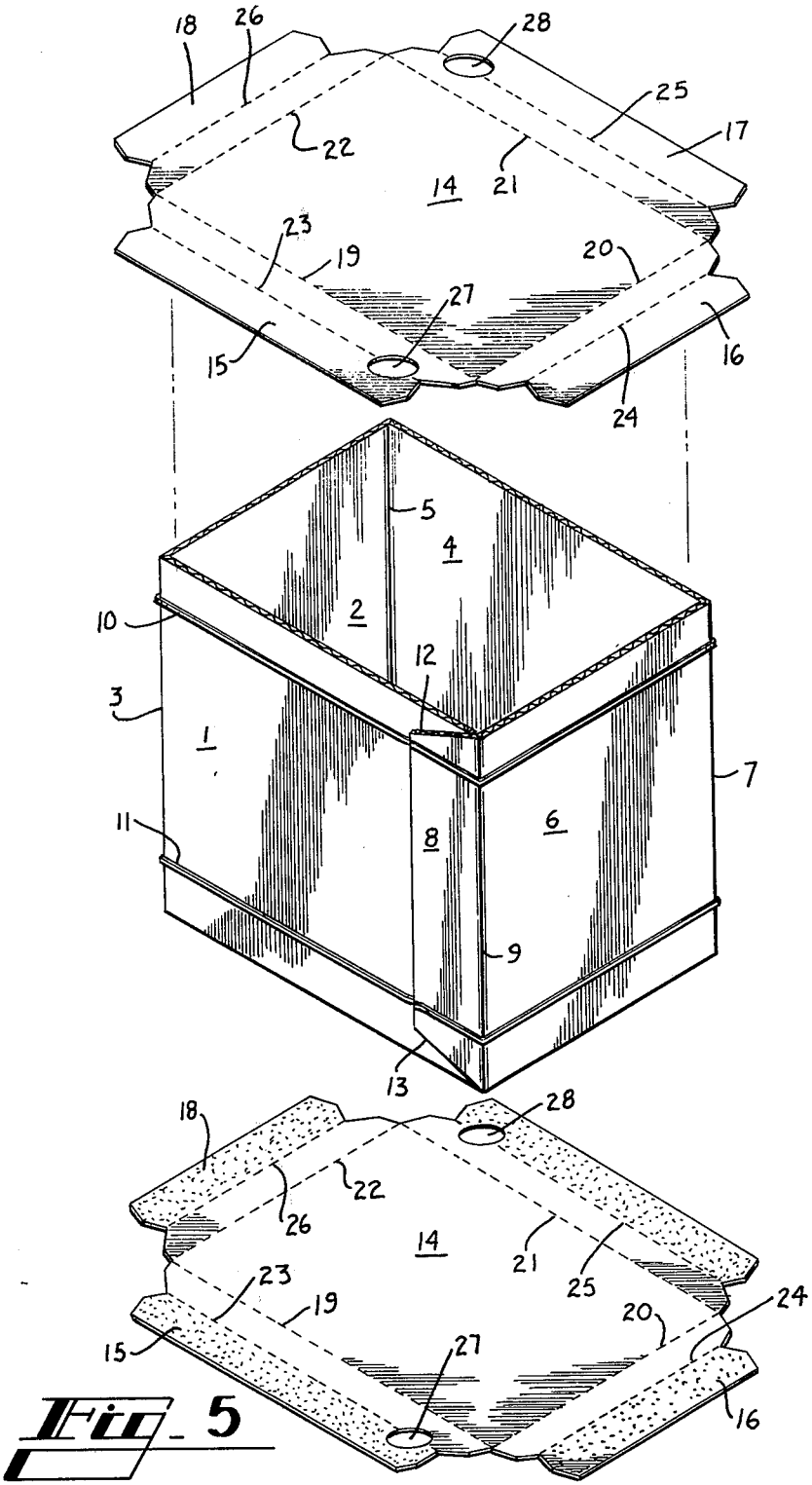
FIG. 5 is an exploded isometric view showing the closure caps and the article container sleeve.

In order to form the article container according to this invention, initially side wall 1 is folded downwardly through 180° along fold line 3 as viewed in FIG. 3. Then an application of glue is made to the underside of glue lap 8 and glue lap 8 together with end wall 6 are folded downwardly 180° along fold line 7 into positions whereby glue lap 8 is adhered to the outer surface of the free end portion of side wall 1. Following this the side and end walls are extended whereby side walls 1 and 4 are parallel and, likewise, whereby end walls 2 and 6 are parallel. The sleeve then appears as shown in FIG. 5.

Figure 1:
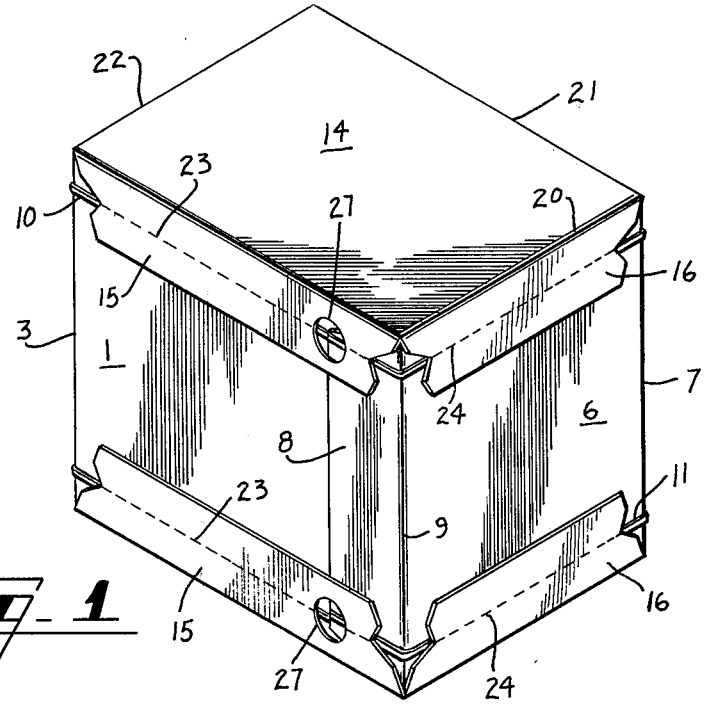
FIG. 1 is an isometric view of an article container formed according to this invention.

Glue is then applied to the portions of two caps attachment flaps between crease lines 23–26 and the respective outer edges thereof. Following loading of articles into the sleeve, the closure caps 14 are positioned perpendicular to the side and end walls and in substantial coincidence with the respective openings of the article container sleeve. Machine manipulation of the closure caps 14 is facilitated by alignment notches a and b. Then attachment flaps 15–18 are folded downwardly and upwardly as the case may be along fold lines 19–22 respectively into glued relationship with the respective side and end walls of the article container which then appears as shown in FIG. 1.

Figure 2:
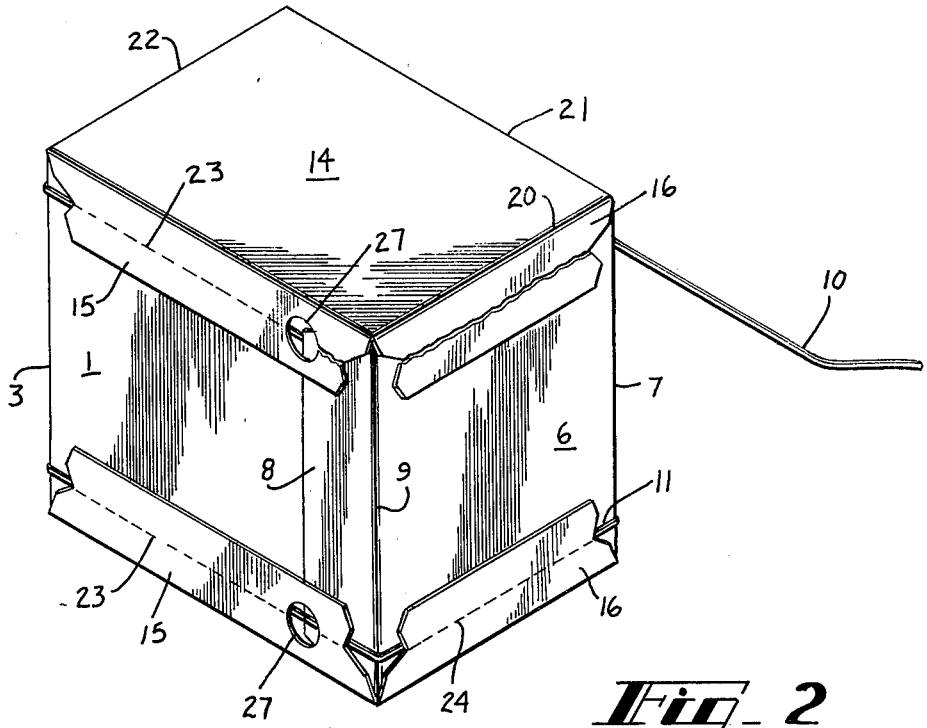
FIG. 2 is a view similar to FIG. 1 with a container opening tear strip partially removed.

In order to open the article container, ends 12 and 13 of tear strips 10 and 11 are simply grasped through the appropriate access aperture 27 or 28 and then pulled outwardly. At this point the respective alignment notch a or b enhances initiation of tearing of the attachement flap by the tear strip which is then guided in the proper direction by the respective crease line 23–26. Then tear strips 10 and 11 are simply separated from the article container which causes closure caps 14 to be released. This operation is illustrated in FIG. 2. The packaged contents are then fully exposed for appropriate removal. Of course although two closure caps are shown in the drawings, only one is necessary for purposes of affording access to the article container.

INDUSTRIAL APPLICABILITY

By this invention, an article container is provided which is extremely sturdy and economical and at the same time has convenient opening means.

We claim:

1. An article container comprising a pair of spaced side walls and a pair of spaced end walls joined together to form a sleeve, at least one closure cap disposed perpendicular to said side and end walls and in coincidence with an opening of said sleeve, said closure cap having an attachment flap foldably joined to at least one edge thereof, said attachment flap being disposed in overlapping relationship with the associated outer surface of one of said walls and being secured thereto along a part thereof remote from said closure cap, a tear strip intermediate said one wall and said attachment flap and engageable with said attachment flap in the area thereof between said part and said closure cap, said tear strip extending substantially the length of said attachment flap, and an access aperture formed in said attachment flap.

2. An article container according to claim 1 wherein a glue lap is foldably joined to an end edge of one of said walls and is disposed in overlapping face contacting relationship with the associated outer surface of the adjacent wall and is adhered thereto.

3. An article container according to claim 1 wherein said access aperture is formed in said attachment flap adjacent one end thereof.

4. An article container according to claim 1 wherein an alignment notch is formed along one end edge of said attachment flap.

5. An article container according to claim 4 wherein said alignment notch is V-shaped and the apex thereof is in substantial coincidence with said tear strip.

6. An article container according to claim 1 wherein an end of said tear strip is disposed substantially within said access aperture so as to afford convenient access thereto.

7. An article container according to claim 1 wherein a crease line is formed in said attachment flap and is disposed in general coincidence with said tear strip to facilitate removal of said tear strip.

8. An article container according to claim 7 wherein said attachment flap is adhered to said wall intermediate said crease line and the outer edge of said attachment flap.

9. An article container comprising a pair of spaced side walls and a pair of spaced end walls, a glue lap foldably joined to an end edge of one of said walls and secured in overlapping face contacting relationship with the associated outer surface of the adjacent wall to form a sleeve, a closure cap disposed perpendicular to said side and end walls and in coincidence with an opening of said sleeve, said closure cap having attachment flaps foldably joined respectively to the edges thereof, said attachment flaps being secured respectively in overlapping relationship with said walls, a tear strip disposed intermediate said walls and said attachment flaps, and an end edge of said tear strip being adjacent the free edge of said glue lap.

10. An article container according to claim 9 wherein an access aperture is formed in the one of said attachment flaps associated with said glue lap and arranged so as to expose said end edge of said tear strip.

* * * * *